United States Patent [19]

Cartabbia

[11] 4,423,561

[45] Jan. 3, 1984

[54] COAT PRESS

[76] Inventor: Giovanni Cartabbia, Via Fusline, 36, 25036, Palazzolo Sull'oglio, Italy

[21] Appl. No.: 286,206

[22] Filed: Jul. 23, 1981

[30] Foreign Application Priority Data

Aug. 4, 1980 [IT] Italy ..... 23913 A/80

[51] Int. Cl.[3] ..... D06F 71/28

[52] U.S. Cl. ..... 38/23; 223/70

[58] Field of Search ..... 38/22, 23, 5, 20, 21, 38/24, 17; 223/68, 70, 72, 73

[56] References Cited

U.S. PATENT DOCUMENTS

| | | | |
|---|---|---|---|
| 2,139,066 | 12/1938 | Bicknell | 28/23 |
| 2,241,373 | 5/1941 | Rawlinson et al. | 38/22 X |
| 2,556,147 | 6/1951 | Pearson | 38/23 |
| 3,349,976 | 10/1967 | Lew | 223/73 |
| 3,624,795 | 11/1971 | Martin | 223/70 |

FOREIGN PATENT DOCUMENTS

| | | | |
|---|---|---|---|
| 2068021 | 8/1981 | United Kingdom | 223/73 |

*Primary Examiner*—Werner H. Schroeder
*Assistant Examiner*—Andrew M. Falik
*Attorney, Agent, or Firm*—Bucknam and Archer

[57] ABSTRACT

An ironing machine comprises two half-manikins including four portions, that is a bust portion, a sleeve top portion, a shoulder portion and a sleeve portion, capable of supporting corresponding portions of a coat or similar cloth articles. The sleeve supporting portion may be horizontally withdrawn or advanced, with respect to the bust-shoulder assembly, and furthermore is provided with a resilient structure for recovering the sleeve size and shape. The half-manikin bust forming portion includes a movable board for ironing the sleeve top portion.

7 Claims, 6 Drawing Figures

COAT PRESS

BACKGROUND OF THE INVENTION

The present invention relates to an ironing machine or apparatus, effective to carry out a simultaneous ironing of the shoulder, top and sleeve portions of a sleeve of a coat or the like.

As is known in the cloth pressing industry several types of ironing presses are available.

In particular, for ironing coats and the like ironing machines are provided with interchangeable shaped elements and manikins.

While affording the possibility of ironing different size clothes these ironing machines, on the other hand require a plurality or shaped elements and manikins, capable of accomodating the specific production technique, or style, of the clothes being ironed.

Moreover, in the known ironing machines, the particular shapes of the cloth articles are obtained by a preliminary manual preparation of the cloth articles, on the manikins, by the operator.

Finally, the conventional ironing machines do not comprise means for simultaneously ironing the top portion of a sleeve and the sleeve itself.

The present invention permits the elimination of the above mentioned drawbacks of the known coat sleeve ironing machines, by providing an ironing machine which is capable of simultaneously ironing the shoulder, top and sleeve portion of a coat or the like cloth article sleeve.

SUMMARY OF THE INVENTION

According to one aspect of the present invention, there is provided an ironing machine for ironing coats and the like cloth articles, characterized in that it comprises two half-manikins, generally of mirror-image symmetrycal, formed by a half-bust, shoulder and sleeve assembly. The half-bust, shoulder and sleeve are coupled releasably to one another. The sleeve forming structure is adjustable, with respect to the bust, in such a way as to afford the possibility of being rotated and/or shifted the half-bust forming portion including a movable board capable of carrying out the ironing of the sleeve top portion. The sleeve supporting structure is provided with a flexible rod shaped portion, capable of carrying out the recovery of the size and shape of the sleeve, said ironing machine being further characterized in that it comprises a pair of movable adjoining plates, capable of being brought together for ironing the sleeve.

BRIEF DESCRIPTION OF THE DRAWINGS

These and other characteristics, of functional and constructional nature, of the coat and the like cloth article ironing machine, according to the present invention, will become more apparent from the following detailed description of a preferred embodiment whereof, with reference to the accompanying drawings, where.

DESCRIPTION OF THE PREFERRED EMBODIMENT

Figure 2:
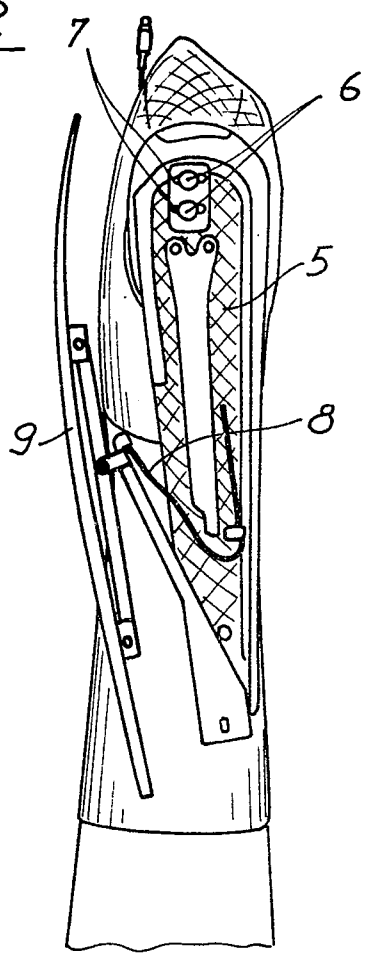
FIG. 2 is a side view illustrating one of the half-manikins associated with the ironing machine according to the invention.
Figure 1:
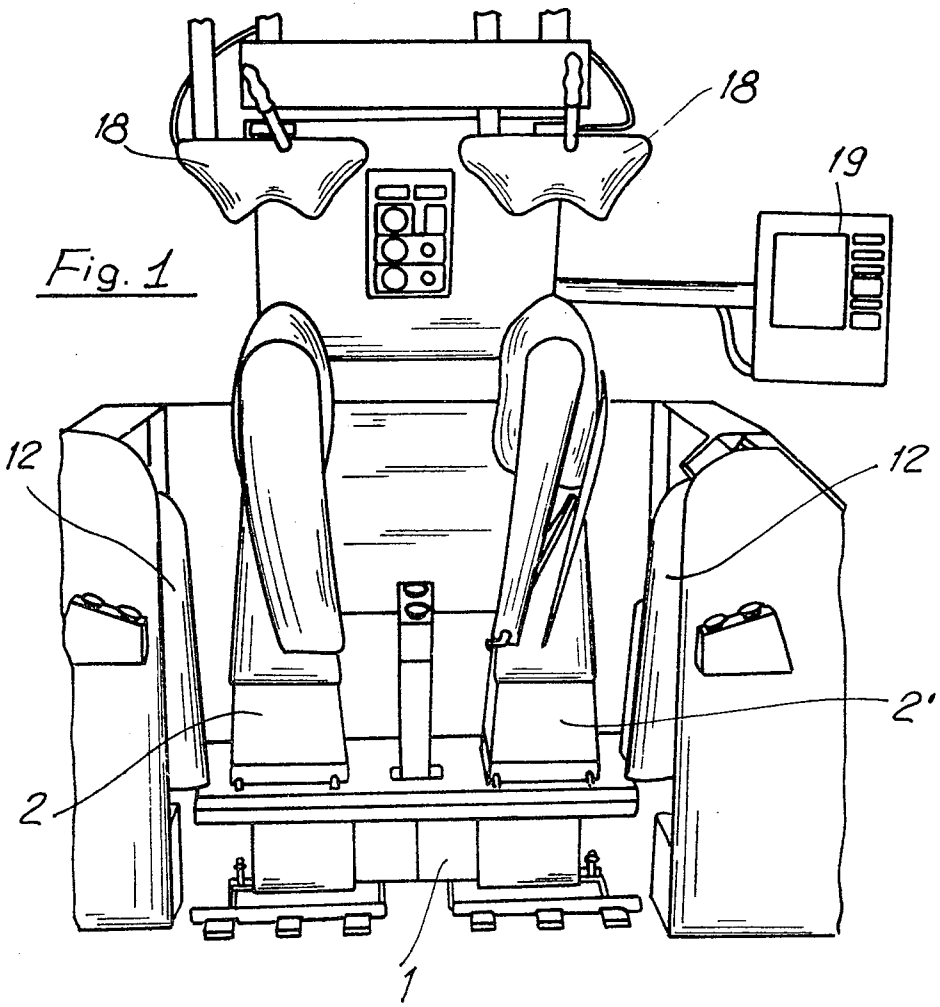
FIG. 1 is a front schematic view illustrating the ironing machine according to the present invention.
Figure 4:
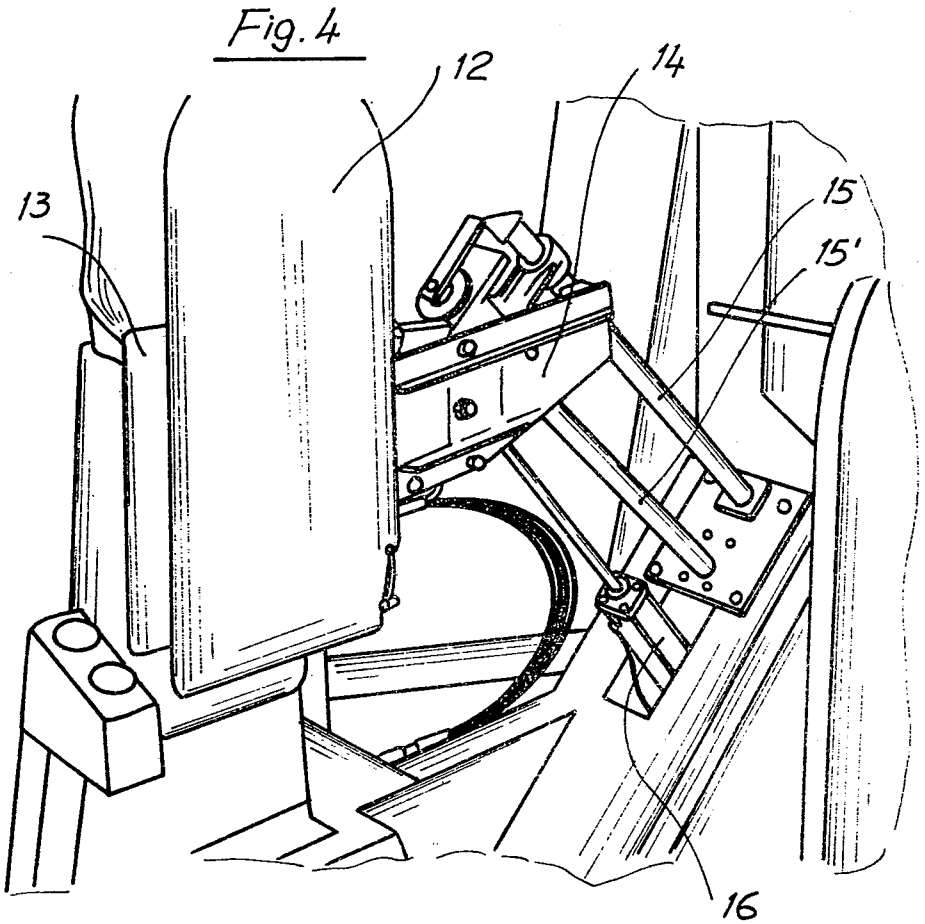
FIG. 4 illustrates the device for driving the sleeve ironing plates.
Figure 3:
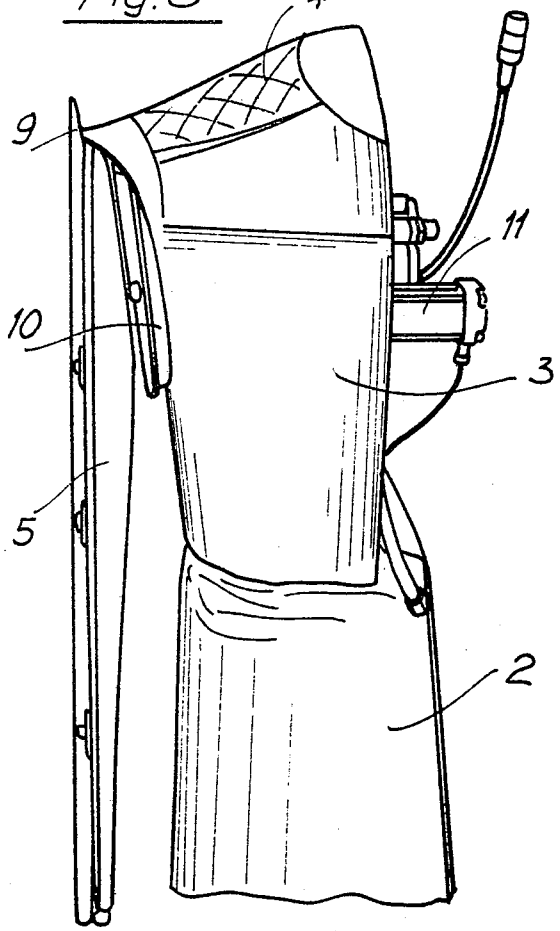
FIG. 3 is a front view illustrating the half-manikin.
Figure 5:
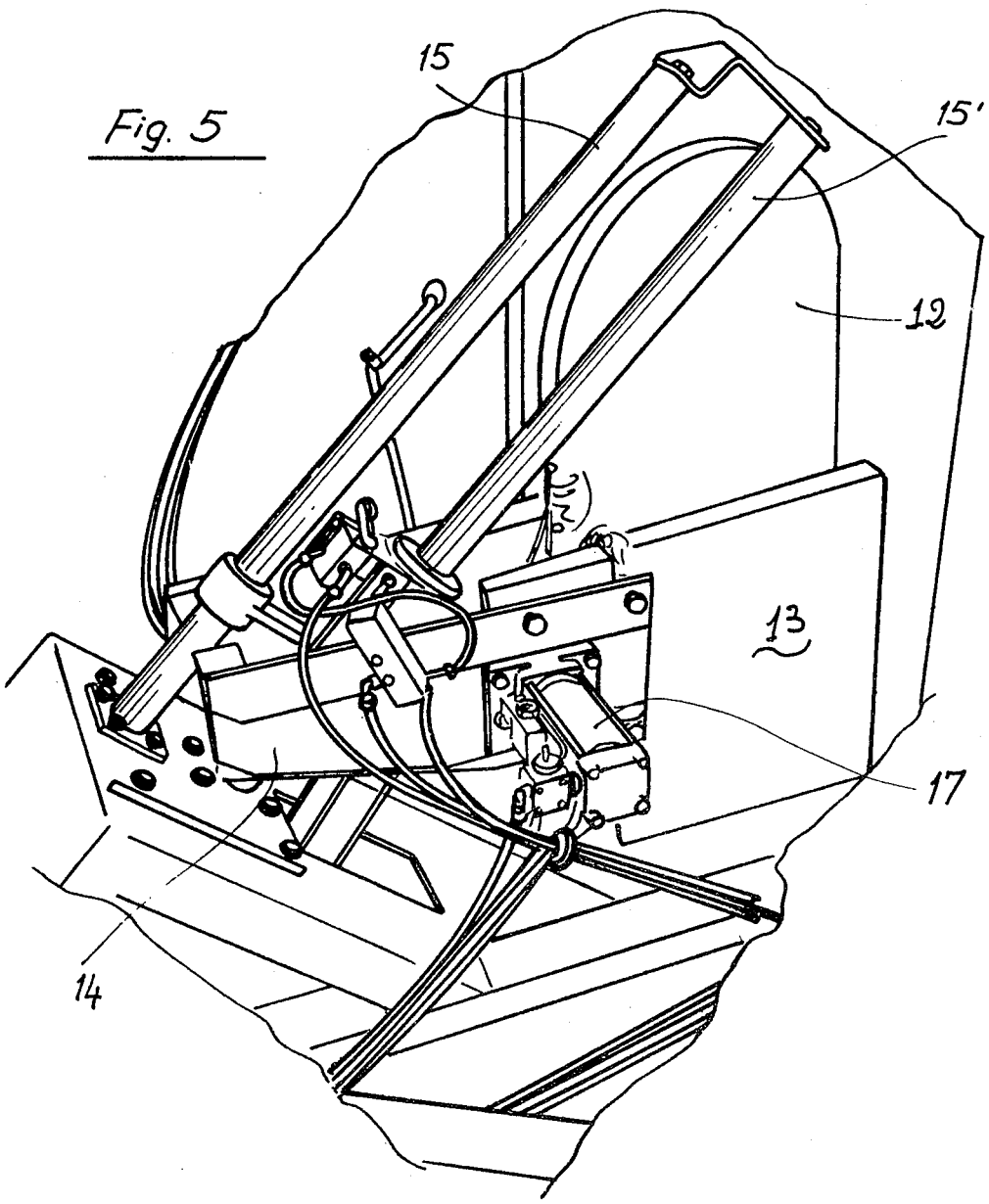
FIG. 5 is a perspective view, from the rear, illustrating sleeve ironing plate driving device.
Figure 6:
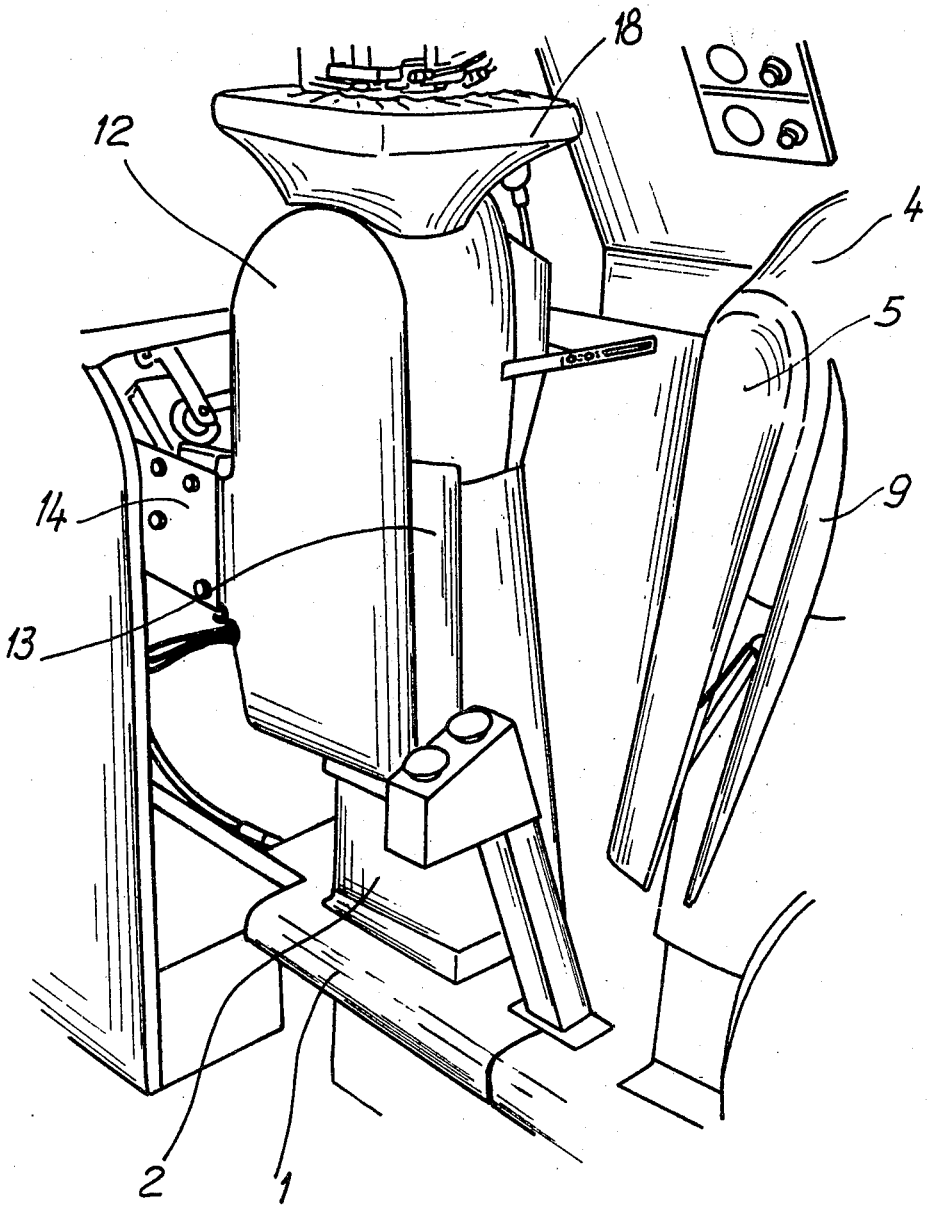
FIG.6 illustrates the ironing step wherein a half-coat is ironed.

With reference to the number references of the figures of the accompanying drawings, the ironing machine for ironing coats and the like cloth articles, according to the present invention, comprises a supporting table 1, on which are mounted, preferably at opposite positions, two vertically extending structures 2 and 2', capable of supporting corresponding half manikins having a mirror symmetry.

The half-manikins are formed by movably coupling three portions respectively shaped as a half-bust 3, a shoulder 4 and a sleeve 5.

By means of this construction, it is possible to change the portions of the machine to fit the manikin shape to the style of the coat to be ironed.

The sleeve forming structure 5, in particular, is applied to the shoulder by means of two bolts 6, which are engaged in corresponding slots 7.

This coupling permits slanting the sleeve portion with respect to the bust, in such a way as to fit the sleeve configuration.

The structure, moreover, may be horizontally advanced or withdrawn, with respect to the shoulder, for shaping the coat.

To the same structure 5, moreover, there is pivoted a flexible rod member 9, biassed by a resilient means 8, the rod member being effective to permit the recovering of the size and sleeve shape.

The half-manikin bust forming portion 3 comprises a movable board 10, which, being driven by the piston of a double acting cylinder (11), provides for the ironing of the sleeve top portion.

Near the half-manikins there are located two adjoining movable plates, 12 and 13, of suitable shape, capable of cooperating for ironing the sleeve.

These movable plates are mounted cantileverwise on a supporting member 14, which is slidingly guided on two sliding guides 15 and 15', and driven therealong by means of a double acting cylinder 16.

The same plates are mutually brought together for ironing the sleeve and then moved apart by means of another cylinder 17, the operation of which is controlled by said double acting cylinder The ironing of the shoulder is carried out by a pressing device 18, provided with a reciprocating motion in the vertical direction and having a suitably shaped surface.

All of the aforesaid mentioned supporting and ironing structures, obviously, are provided with perforated surfaces capable of providing, depending on the needs, a blowing, sucking or vaporizing action.

It should be also pointed out that the ironing machine according to the present invention may also be advantageously controlled by an electronic controlling unit 19, as preliminarly programmed.

From the above description and the observation of the figures of the accompanying drawings the broad utility of the instant ironing machine is apparent.

Obviously this ironing machine has been thereinabove described and illustrated only as an indicative and not a limitative example and only to demonstrate the practical manner for carrying into effect the present invention and its main features.

Accordingly, from the above it is possible to deduce that the ironing machine according to the present invention and its component parts are susceptible to all of the modifications and variations as suggested by the experience, according to the needs.

These variations can be brought in the thereinabove described operative portions, which are characteristics of the present invention, as well as in the construction and/or assemblying method thereof, without departing from the scope of the present invention.

I claim:

1. An ironing machine for ironing coats, sections of coats and like articles which machine comprises a base means (1); a pair of half-manikins each supported by said base means and having respective configurations that are generally of mirror-image symmetry, each half-manikin including a half-bust form assembly (3), a shoulder form assembly (4) and a sleeve form assembly (5) releasably coupled together, said sleeve form assembly being adjustably movable in relation to said shoulder form assembly, said half-bust form assembly (3) including a movable board operable to iron the top sleeve portion of a coat put on the half-manikin, said sleeve form assembly including a flexible rod means operable to recover the size and shape of the sleeve of a coat put on the half-manikin; and a pair of plates supported for movement relative to said base means and for movement relative to said sleeve form assembly for cooperation therewith in ironing the coat sleeves.

2. The ironing machine, according to claim 1, wherein said sleeve form assembly is applied to said shoulder form assembly by means of bolts engageable in corresponding slots and said flexible rod means is a shaped rod member pivoted to said sleeve assembly, said rod member being biassed by resilient means.

3. The ironing machine, according to claim 1, which comprises piston means of a first double-acting cylinder (11) adapted to actuate said movable board.

4. The ironing machine, according to claim 1, wherein said movable plates are located near said half-manikins, said movable plates being mounted cantileverwise on a supporting member which slides on two parallel sliding guides and is driven therealong by means of a second double-acting cylinder (16).

5. The ironing machine, according to claim 4, which comprises a third cylinder (17) adapted to bring together and move apart said plates, the operation of said third cylinder being controlled by said supporting member.

6. The ironing machine, according to claim 1, which comprises a vertically reciprocating pressing device provided with a shaped surface for ironing the shoulders of the coats or the like.

7. The ironing machine, according to claim 1, which comprises an electronic controlling unit for programming said shoulder form assembly, said half-bust assembly and said sleeve form assembly.

* * * * *